US005360360A

United States Patent [19]

Peterson

[11] Patent Number: 5,360,360

[45] Date of Patent: Nov. 1, 1994

[54] INFLATABLE TOWABLE CHARIOT

[75] Inventor: Leroy L. Peterson, Omaha, Nebr.

[73] Assignee: Sportsstuff, Inc., Omaha, Nebr.

[21] Appl. No.: 75,413

[22] Filed: Jun. 14, 1993

[51] Int. Cl.[5] ..... B63C 9/08

[52] U.S. Cl. ..... 441/130; 297/DIG. 3

[58] Field of Search ..... 441/65-67, 441/75, 128-132; 297/DIG. 3

[56] References Cited

U.S. PATENT DOCUMENTS

| | | | |
|---|---|---|---|
| D. 187,313 | 2/1960 | Denyer | 441/132 |
| 1,960,474 | 5/1934 | Browne | 441/129 |
| 4,552,539 | 11/1985 | Hoenstine et al. | 441/66 |
| 4,601,667 | 7/1986 | Hull | 441/131 |
| 4,678,444 | 7/1987 | Monreal | 441/65 |
| 4,905,332 | 3/1990 | Wang | 441/130 |
| 5,005,902 | 4/1991 | Farnworth et al. | 297/DIG. 3 |

*Primary Examiner*—Jesus D. Sotelo
*Attorney, Agent, or Firm*—John A. Beehner

[57] ABSTRACT

An inflatable towable chariot includes a generally U-shaped inflatable wall bladder insertable within an exterior jacket including a generally U-shaped wall pocket of a size and shape to receive and be substantially filled by the wall bladder upon inflation of the wall bladder. A floor is connected to the pocket and spans and substantially covers the area partially enclosed by the pocket for supporting a passenger on the chariot. The floor may likewise be constructed as a pocket for receiving either an inflatable floor bladder, or a rigid floor insert. Upon inflation of the wall bladder, the bladder and exterior jacket partially define the shape of one another and reinforce one another afford a relatively rigid raised wall. Handles on the exterior jacket accommodate securement of a passenger in any desired standing, kneeling, sitting or reclining position. The towing system includes a generally triangular shaped tongue covered by relatively nonstretchable fabric and secured to the exterior jacket across the rearward edge thereof to minimize side to side wobbling during towing of the chariot.

14 Claims, 5 Drawing Sheets

INFLATABLE TOWABLE CHARIOT

BACKGROUND OF THE INVENTION

1. Technical Field

The present invention is directed generally to inflatable recreational passenger support devices and more particularly to a generally chariot-shaped towable inflatable apparatus for use on water and snow.

2. Description of the Prior Art

Towable inflatables for recreational water use likely originated with a rope tied to an automotive tire inner tube and pulled by a boat. In fact, a modified form of this early inner tube has survived all competition to remain one of the most popular towable inflatables on the market. The new tubes, or rings as they are called, include either a pvc or rubber tube situated within a fabric cover having a towing strap extended from one edge for connection to a power boat or the like. But such rings are not designed to accommodate more than one passenger; they ride so low as to afford little visibility to other traffic and the low profile affords little if any protection for passengers from wind, water, or any object which the ring may accidentally strike.

One competitive inflatable device was the torpedo which was generally a long inflatable tube secured to a towing rope at one end and adapted to support multiple riders stratling the tube in generally horseback riding positions. Whereas this device gave the riders a different sensation than the conventional ring, it requires substantial skill on the part of the rider since it rolls easily in the water and, like the ring, it also has a very low profile not easily viewed by other traffic.

For one to enjoy water sports in a standing or kneeling position, it has heretofore been necessary to use some device other than inflatables such as water skies or the more recently popular knee board which affords a surfboard-like experience for one being pulled behind a power boat. These devices also require the passenger to develop riding skills before they can be enjoyed and neither device provides protection from wind, water, objects and the like.

Accordingly, the present invention is directed to an improved inflatable passenger support device.

Another object is to provide an inflatable towable passenger support device in the shape of a chariot with raised front wall and side walls and a floor surface for supporting one or more passengers thereon in a standing, kneeling, sitting or reclining position.

Another object is to provide an inflatable towable chariot having multiple handles on the top edge thereof and exterior side walls to accommodate both forward and side to side leaning movements of the chariot.

Another object is to provide an inflatable towable chariot having raised side walls which enable the chariot to be easily seen by other traffic on the water or snow.

Another object is to provide an improved inflatable towable chariot wherein an inflatable U-shaped wall bladder is enclosed within a fabric jacket such that the bladder and jacket reinforce one another to afford a generally rigid wall structure for protecting and securing the passenger or passengers on the chariot.

Another object is to provide an inflatable towable chariot which is stable when being towed and easily mounted by a swimmer in the water adjacent the stationary chariot.

Another object is to provide an improved inflatable towable chariot having a generally continuous triangular towing system to minimize side to side wobbling of the chariot in use.

Finally, an object of the invention is to provide an improved inflatable towable chariot which is simple and rugged in construction, economical to manufacture and efficient in operation.

SUMMARY OF THE INVENTION

The inflatable chariot-style passenger support apparatus of the present invention includes a generally U-shaped inflatable wall bladder encased within an exterior jacket including a generally U-shaped pocket of a size and shape to receive and be substantially filled by the wall bladder upon inflation of the wall bladder. A floor is connected to the pocket and spans and substantially covers the area partially enclosed by said U-shaped pocket for supporting a passenger thereon. Handles are provided adjacent the top edge of the jacket pocket and on the exterior walls thereof adjacent the rearward end of the chariot for a passenger to hold on to both when the chariot is pulled in a normal forward direction, or when leaning the chariot to accommodate turning movements. To connect the chariot to a towing vehicle, a towing system preferably includes a flexible generally triangular tongue having one edge connected to the U-shaped pocket at a central position adjacent the bottom wall, which tongue includes a generally continuous non-stretchable sheet substantially covering the triangular shape to reinforce the tongue and minimize side to side wobbling movement of the chariot.

The open backed generally U-shaped raised wall is readily visible by other traffic on the water or snow and provides support for handles at an elevated position so that a passenger may comfortably and securely kneel or stand on the floor surface and hold onto the handles as the chariot is towed. The width of the chariot and number of handles are designed to accommodate more than one passenger. Besides standing and kneeling, the passengers may be seated or reclined within the chariot for all sorts of different sensations as the chariot is towed. The raised wall furthermore affords protection for the passenger against wind, water and can cushion any impact should the inflatable accidentally strike some object.

The floor may be either a separate inflatable insert, preferably of longitudinal I-beam construction for rigidity, or a solid board for insertion through a zippered opening in the exterior jacket floor. Suitable openings are provided at rearward portions of both the U-shaped pocket of the exterior jacket and floor for drainage of any water which enters the jacket.

Whereas the raised walls of the U-shaped wall bladder may be constructed of stacked U-shaped tube members, the walls may alternately be formed as a single chamber with horizontal or upright I-beam ribs to conform the walls to the desired upright shape. In one embodiment, the chariot may be formed as an inflatable device without any separate exterior protective jacket.

DESCRIPTION OF THE PREFERRED EMBODIMENT

Figure 1:
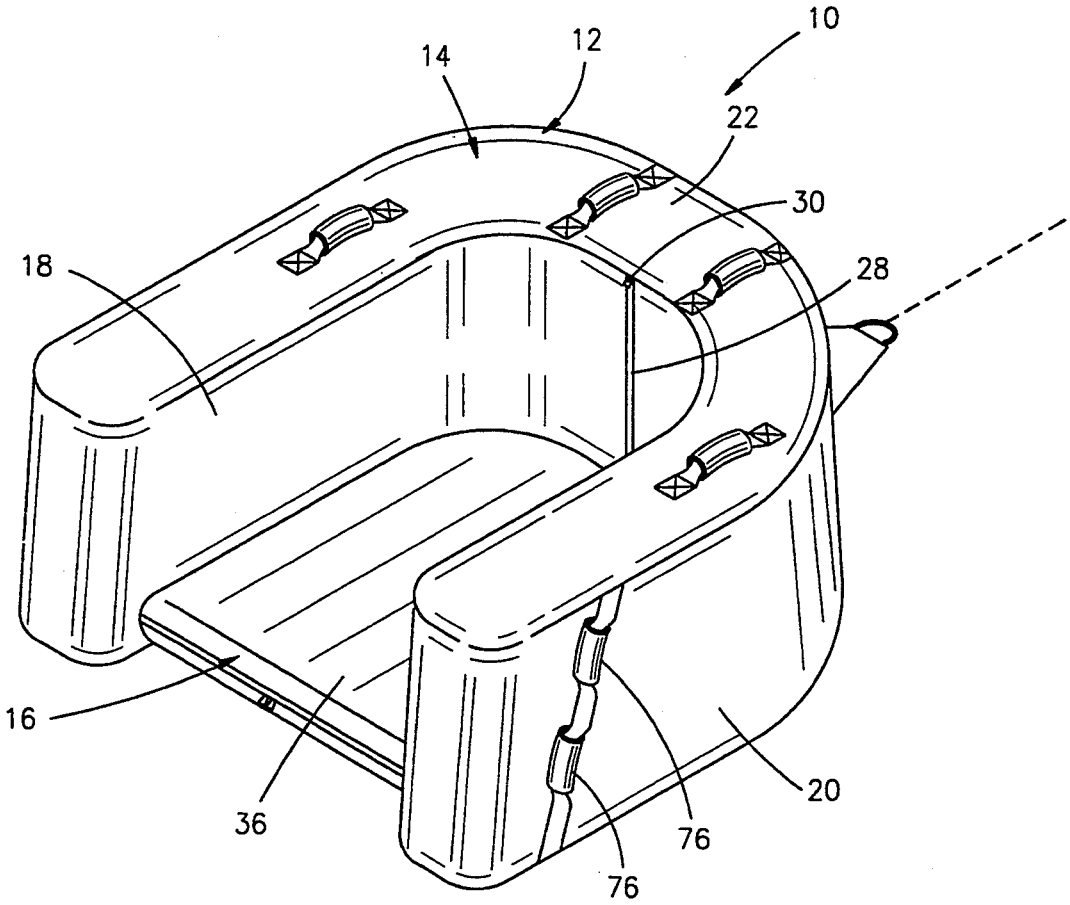
FIG. 1 is a perspective view of a preferred embodiment of the invention.
Figure 2:
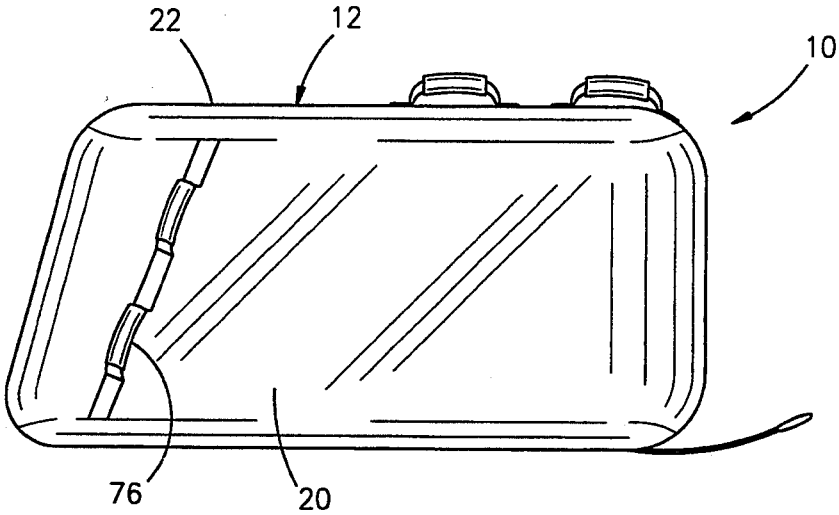
FIG. 2 is a side elevational view thereof.

The inflatable towable chariot 10 of the present invention is illustrated, in a preferred embodiment, in FIGS. 1 through 9, as including an exterior jacket 12 including a raised upright generally U-shaped wall pocket 14 and a floor 16 connected to the pocket and spanning and substantially covering the area partially enclosed by the pocket for supporting a passenger thereon.

Figure 6:
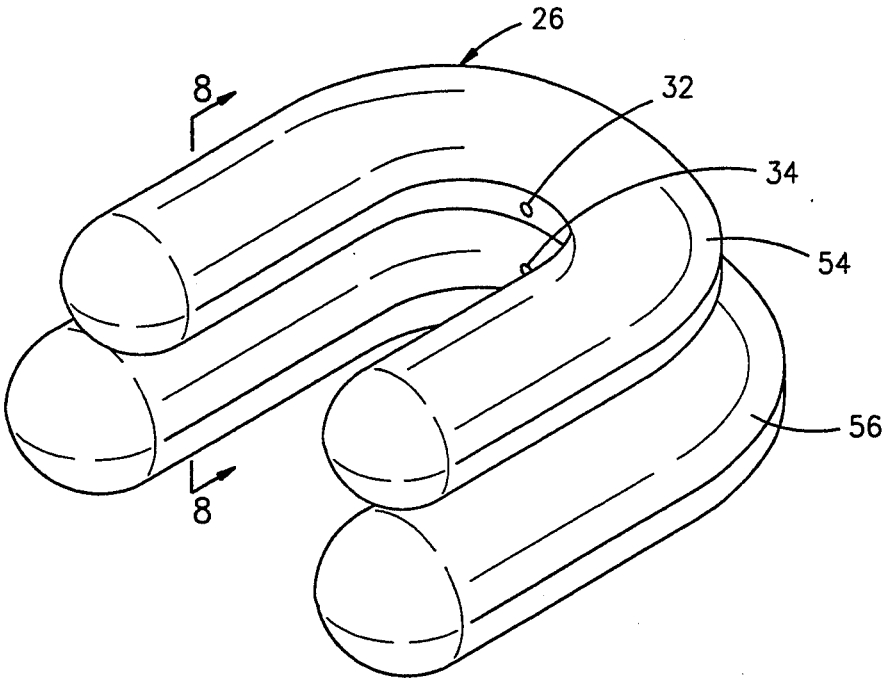
FIG. 6 is a perspective view of the front horseshoe bladder assembly.

The generally U-shaped wall pocket 14 of the exterior jacket 12 has a generally U-shaped interior wall 18, a generally U-shaped exterior wall 20 and top and bottom walls 22 and 24 to define an enclosed U-shaped chamber for receiving a raised upright inflatable wall bladder 26, as shown in FIG. 6. The U-shaped wall pocket 14 preferably has an upright zipper opening 28 at a central position on interior wall 18, which opening can be opened and closed by a zipper 30 to accommodate insertion and removal of the inflatable wall bladder 26 in a deflated condition. Zipper opening 28 also provides access to the inflation valves 32 and 34 of the wall bladder 26, as shown in FIG. 6. Upon insertion of the wall bladder 26 into the U-shaped wall pocket 14 and upon inflation of the wall bladder 26, the bladder fills the pocket and both the bladder 26 and pocket 74 tend to partially define the shape of the other and reinforce one another to afford a generally rigid wall capable of supporting and protecting a passenger riding on the chariot.

The interior, exterior, top and bottom walls of the U-shaped wall pocket 14 are preferably interconnected by interlocking double stitching with binding on the seams. The material of the exterior jacket may be any fabric or other sheet material which will add puncture resistance to the wall bladder 26. A generally non-stretchable fabric is preferred. It is preferred that at least the bottom wall to which the towing system is secured be 850 D or 1000 D nylon commercially available under the name Cordura. The upper walls of the exterior jacket may be of the same material or a lighter 600 D or 420 D nylon or nylon with pvc coating. The various walls of the exterior jacket afford ample surface area for colorful graphics, written indicia, advertisements or the like, all of which compliment the raised height of the chariot walls to provide increased visibility for safer operation.

Figure 7:
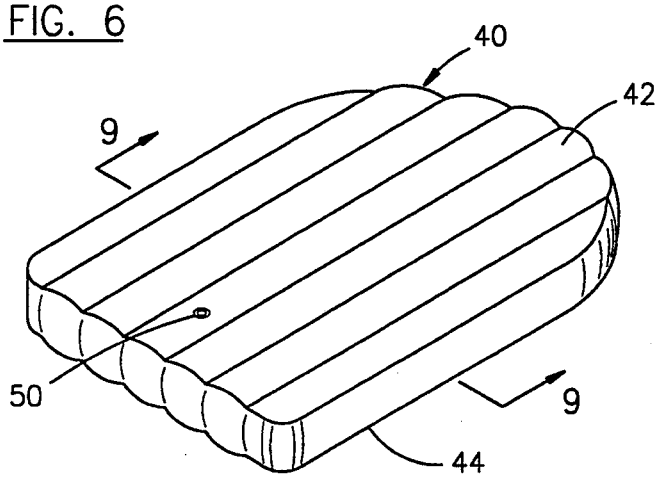
FIG. 7 is a perspective view of the floor bladder.

The floor 16 preferably includes a top sheet 36 and a bottom sheet 38 defining a floor pocket of a size and shape to receive and be substantially filled by a stiffening insert. FIG. 7 illustrates an inflatable insert in the form of a floor bladder 40. Bladder 40 includes top and bottom walls 42 and 44, preferably of pvc sheet material and a heat seal peripheral seam as indicated at 46. The flat shape and rigidity are provided by a plurality of longitudinally extended interior I-beams 48 which define interior chambers interconnected for filling by one or more air filler valves 50. Whereas a preferred floor bladder 40 is illustrated, it is readily apparent that the floor bladder could be constructed of "X-beam" construction, rather than "I-beam" construction; the beams may run either transversely or horizontally; all with the object of providing a relatively rigid floor insert for secure, safe and comfortable support of passengers riding on the chariot.

Figure 13:
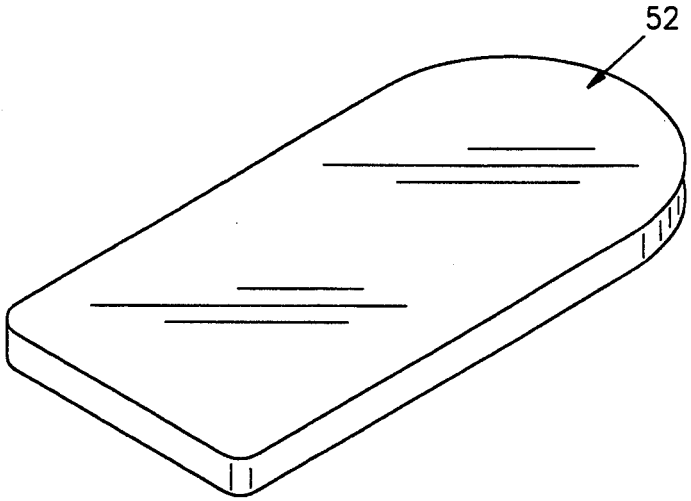
FIG. 13 is a perspective view of a solid board floor insert as a replacement for the inflatable floor bladder of FIG. 7.

Added rigidity may be provided by replacing the floor bladder 40 with a solid floor board insert 52, as illustrated in FIG. 13. Floor board insert 52 may be made of plywood, perhaps ¾" in thickness, plastic board or the like.

Figure 8:
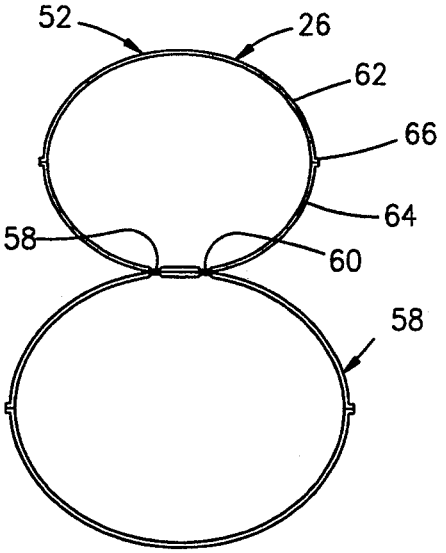
FIG. 8 is an enlarged sectional view taken along line 8—8 in FIG. 6.
Figure 9:
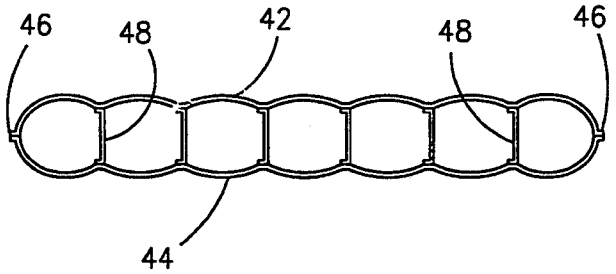
FIG. 9 is an enlarged sectional view taken along line 9—9 in FIG. 7.

One embodiment of the wall bladder 26 is illustrated in FIGS. 6 and 8. In this embodiment, the wall bladder 26 includes a separately inflatable top tube 54 and bottom tube 56 stacked one upon the other and a pair of spaced heat sealed seams 58 and 60 for securing the tubes together. As shown in FIG. 8, the top tube 54 is preferably constructed with a top sheet 62 and bottom sheet 64 heat sealed together along a continuous peripheral seam 66 and including the inflation valve 32 as shown in FIG. 6. The bottom tube 56 is of similar construction but preferably of larger diameter so that the walls have a slightly upwardly tampering width for added rigidity.

It is apparent that the raised U-shaped wall bladder 26 may be constructed many different ways such as a single chamber wall structure having the shape defined by spaced apart horizontal or transverse I-beam ribs of similar pvc sheet material, for example. It is simply important that the wall bladder 26 be constructed to afford a relatively rigid U-shaped insert for the U-shaped wall pocket 14 of exterior jacket 12. In a prototype constructed according to the illustrated embodiment in FIGS. 6 and 8, the top tube 54 has a 12" diameter and the bottom tube 56 a 15" diameter. Upon assembly into the exterior jacket 12, that jacket has a height of 27", a front to back length of 51" excluding the towing system and a maximum transverse width adjacent the lower end thereof of approximately 51". The height of the wall is therefore preferably about twice the thickness of the wall. The material of the wall bladder 26 is preferably between 20 and 30 gauge pvc sheet material.

The chariot 10 is equipped with multiple handles 68 on the top wall 22 to accommodate one or more passengers in various positions. The handles are preferably longitudinally oriented and may be formed of a strap of 2" webbing 70 extended through a plastic sleeve 72 enclosed within a foam handle grip sleeve of EVA material, for example. Opposite ends of the webbing 70 are stitched to the top wall 22. The handles 68 are preferably symmetrically arranged two at the front of top wall 22 in spaced apart relation and two more adjacent the front end of the generally parallel side wall portions of the U-shaped wall pocket 14. Additional handles 76 are provided adjacent both rearward ends of the exterior wall 20 of jacket 12. Each adjacent pair of handles 76 may be formed from a single strip of webbing 78 stitched to the exterior wall 20 at opposite ends and between the handle grips 74. The position of these handles 76 both facilitates climbing onto the chariot from the water and they also enable a passenger to grip the chariot for leaning into turns. For example, when the towing boat swings to the right sending the chariot in an arc to the left, the passenger may wish to grasp one of the handles 76 on the left exterior wall and lean to his right to facilitate passage through the turn. The handle positions are also selected to comfortably accommodate a passenger in any position whether he/she be standing, kneeling, sitting or reclining.

Figure 3:
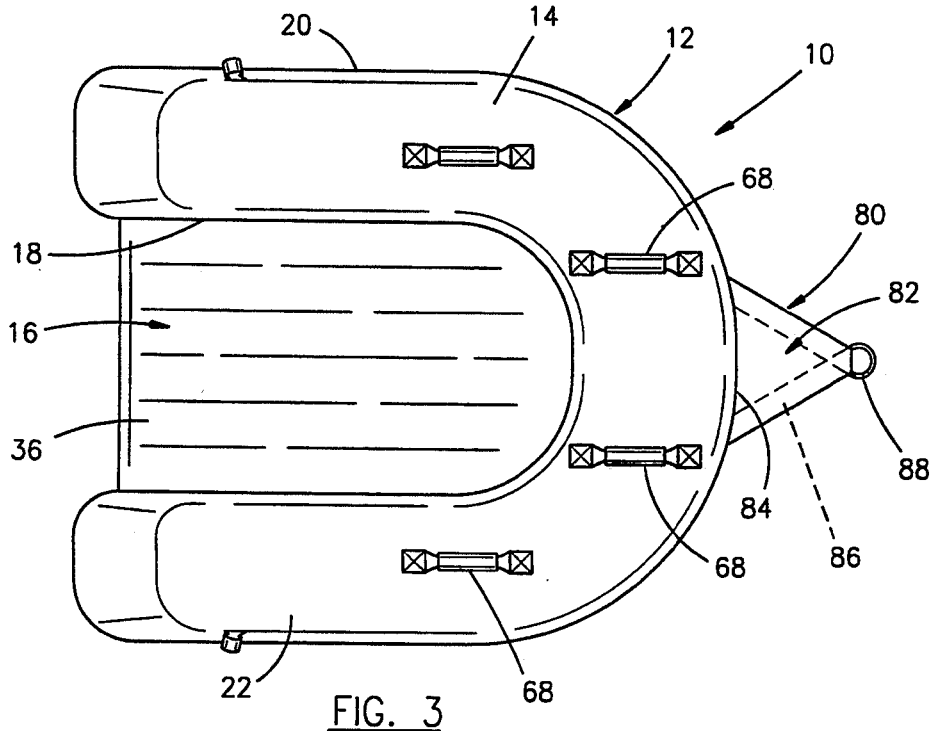
FIG. 3 is a top plan view thereof.
Figure 4:
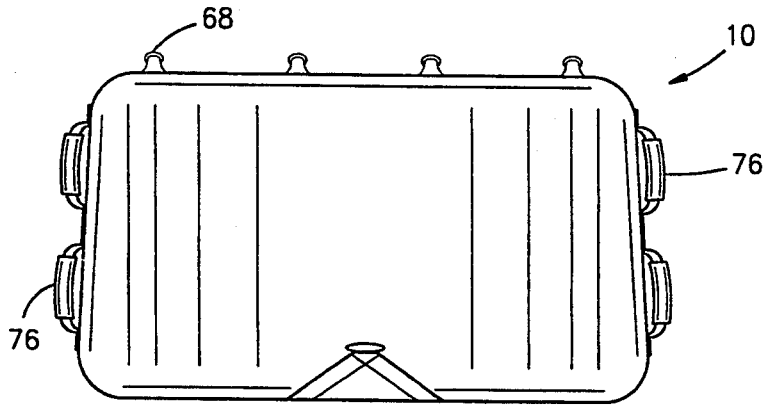
FIG. 4 is a front elevational view thereof.
Figure 5:
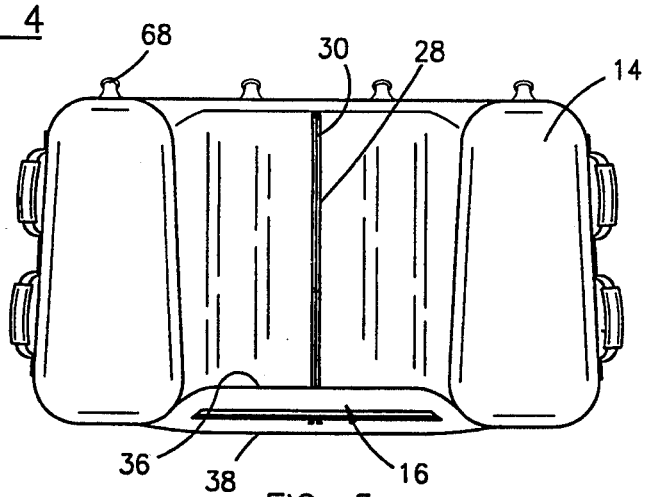
FIG. 5 is a rear elevational view thereof.
Figure 10:
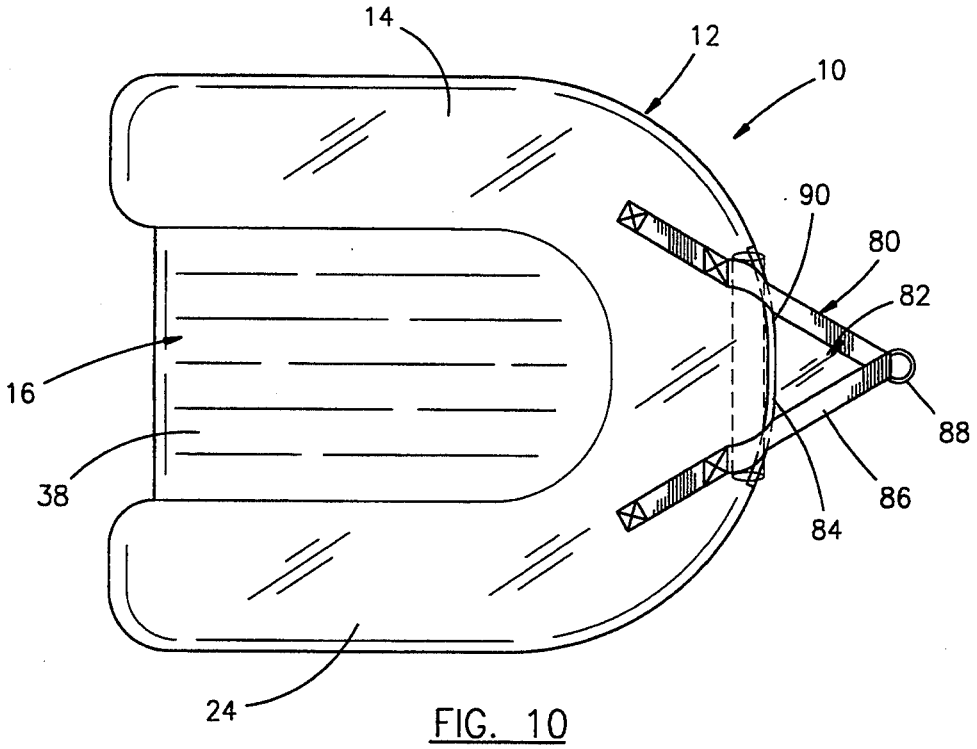
FIG. 10 is a bottom plan view of the invention showing the towing system secured to the exterior jacket.
Figure 11:
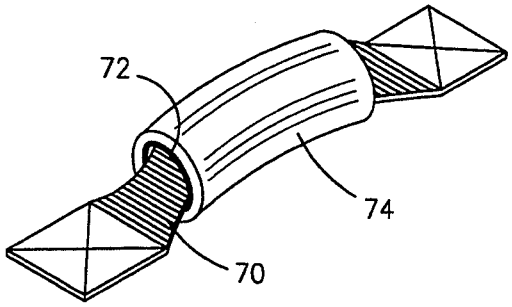
FIG. 11 is an enlarged perspective view of a handle of the invention.
Figure 12:
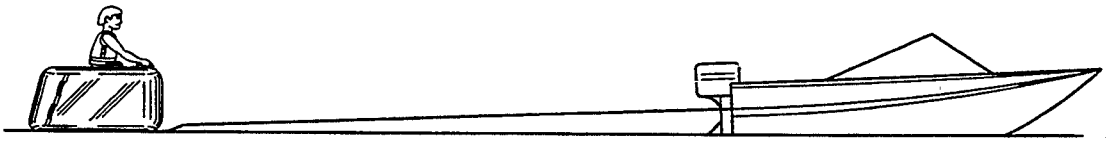
FIG. 12 is a diagrammatic illustration of the invention being towed behind a ski boat.

The towing system 80 is illustrated best in FIGS. 3 and 10 and includes a flexible generally triangular tongue 82 having a rearward edge 84 connected to the U-shaped wall pocket 14 at a central position adjacent the floor 16. The tongue 82 is preferably constructed of an elongated strap 86 folded into a generally V-shape with a D-ring 88 at the free apex thereof and with the rearward opposite ends stitched to the bottom wall 24 of the U-shaped wall pocket 14. The opposite sides of the straps are also stitched to a cross strap 90 which is stitched to a front bottom portion of exterior wall 20 for additional support. The opening between the opposite sides of strap 86 forwardly of exterior wall 20 is closed by a continuous generally nonstretchable sheet material having two edges secured to the strap 86 and a rearward edge secured to cross strap 90 on exterior wall 20. This continuous connection of the tongue to the exterior jacket along the transverse extent of the rearward end of the tongue rigidifies the tongue and stabilizes the chariot 10 against side to side wobbling movement as the chariot is towed through the water or over a snow surface.

Figure 14:
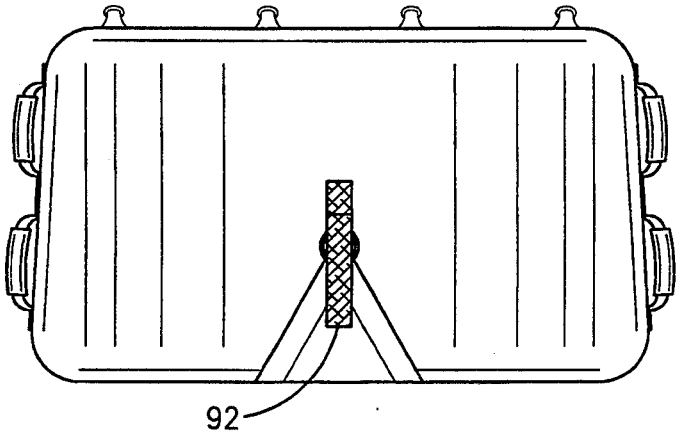
Figure 14 is a front elevational view of the invention illustrating a velcro strap for retention of the towing system in a raised non-use position.

Whereas the inflatable chariot of the invention has been shown and described in connection with a preferred embodiment thereof. It is understood that many modifications, substitutions and additions may be made which are within the intended broad scope of the appended claims. For example, FIG. 14 illustrates a velcro retention strap 92 having an upper end secured by stitching or the like to the front of exterior wall 20 with a lower free end that may be directed through the D-ring 88 of the towing system 80 and doubled back on itself for securement by the hook and loop type Velcro fastening system to support the tongue in an elevated non-use position, such as for sliding down a snow hill.

Figure 15:
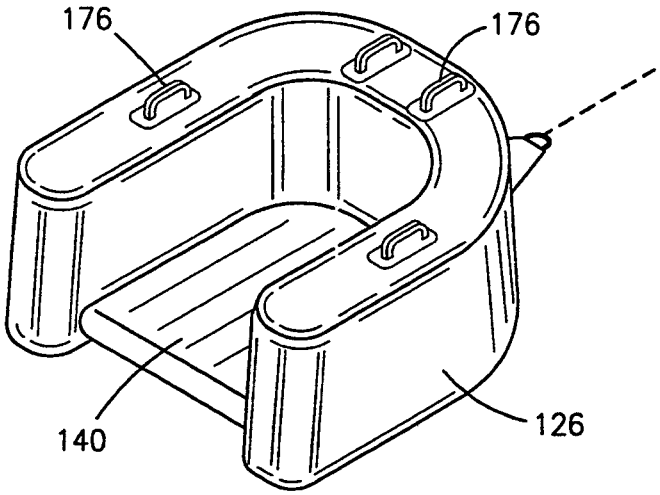
Figure 15 is a perspective view of an inflatable version of the invention without a fabric outer skin cover.

Alternately, FIG. 15 illustrates another embodiment of the invention wherein the chariot is constructed as a combination of an inflatable wall bladder 126 without any exterior jacket 12. In this embodiment, the handles 176 are secured directly to the wall bladder 26. Likewise, the towing system is secured directly to the wall bladder 126.

Whereas the semi-circular rounded U-shape for the chariot is preferred, the term "U-shaped" is alternately intended to encompass a V-shape, square cornered U-shape or any other such shape having a closed front, opposite side walls and open at the back for easy entry onto the floor 16.

I claim:

1. An inflatable horseshoe shaped passenger support apparatus adapted to be towed behind a towing vehicle, said apparatus comprising, a generally U-shaped inflatable wall bladder including two rearwardly extended spaced apart side wall portions and a front wall portion connected to and extended between said side wall portions, each of said wall portions, upon inflation, having a height greater than thickness thereof, an exterior jacket including, a generally U-shaped pocket of a size and shape to receive and to be substantially filled by said wall bladder upon inflation of said wall bladder, said pocket having interior, exterior, top and bottom walls, a floor connected to said pocket and spanning and substantially covering the area partially enclosed by said pocket for supporting a passenger thereon, handle means adjacent the top of said jacket pocket for passengers to hold on to, and a towing system secured to said jacket and extendable forwardly therefrom for connection to a towing vehicle.

2. The horseshoe shaped passenger support apparatus of claim 1 further comprising a floor insert of a shape to substantially fill and cover the area between said wall portions, said floor having a top sheet and bottom sheet defining a floor pocket of a size and shape to receive and be substantially filled by said floor insert.

3. The horseshoe support passenger shaped apparatus of claim 2 wherein said floor insert comprises an inflatable floor bladder.

4. The horseshoe shaped passenger support apparatus of claim 2 wherein said floor insert comprises a solid board.

5. The horseshoe shaped passenger support apparatus of claim 2 wherein said top sheet and bottom sheet are closed at the rear by a zipper for insertion and removal of said floor insert.

6. The horseshoe shaped passenger support apparatus of claim 1 wherein said front wall portion of said wall bladder is generally semicircular in shape.

7. The horseshoe shaped passenger support apparatus of claim 1 wherein said generally U-shaped inflatable wall bladder comprises a separately inflatable top tube and bottom tube stacked one upon the other and means for securing said top tube onto said bottom tube.

8. The horseshoe shaped passenger support apparatus of claim 7 wherein said top and bottom tubes are generally circular in cross section, said top tube having a smaller diameter than said bottom tube.

9. The horseshoe shaped passenger support apparatus of claim 1 wherein said exterior jacket is made of a tough fabric material to reinforce said wall bladder and resist puncture thereof.

10. Passenger support apparatus of claim 1 wherein said towing system comprises a flexible generally triangular tongue having one edge connected to said U-shaped pocket at a central position adjacent said bottom wall, said tongue comprising a continuous generally nonstretchable sheet substantially covering said triangular shape.

11. The horseshoe shaped passenger support apparatus of claim 1 wherein said generally U-shaped inflatable wall bladder has a height approximately twice the thickness thereof.

12. The horseshoe shaped passenger support apparatus of claim wherein said handle means comprises a plurality of handles symmetrically arranged relative to the longitudinal center line of said apparatus, including at least one handle on the exterior wall of said U-shaped pocket adjacent the rearward end thereof on both sides of said pocket.

13. An inflatable horseshoe shaped passenger support apparatus adapted to be towed behind a towing vehicle, said apparatus comprising, a generally U-shaped inflatable wall bladder including two rearwardly extended spaced apart side wall portions and a front wall portion connected to and extended between said side wall portions, each of said wall portions, upon inflation, having a height greater than thickness thereof, a floor connected to said wall bladder and spanning and substantially covering the area partially enclosed by said wall bladder for supporting a passenger thereon, handle means adjacent the top of said wall bladder for passengers to hold on to, and a towing system secured to said wall bladder and extendable forwardly therefrom for connection to a towing vehicle.

14. The horseshoe shaped passenger support apparatus of claim 13 wherein said floor comprises a separate inflatable floor bladder.

* * * * *